US009169616B2

(12) United States Patent
Attwood

(10) Patent No.: US 9,169,616 B2
(45) Date of Patent: Oct. 27, 2015

(54) SPREADER COMPONENT FOR A DRAGLINE EXCAVATOR

(75) Inventor: Reece Attwood, Mayfield West (AU)

(73) Assignee: Bradken Resources Pty Limited, Mayfield West (AU)

( * ) Notice: Subject to any disclaimer, the term of this patent is extended or adjusted under 35 U.S.C. 154(b) by 111 days.

(21) Appl. No.: 13/574,434

(22) PCT Filed: Jan. 19, 2011

(86) PCT No.: PCT/AU2011/000057

§ 371 (c)(1),
(2), (4) Date: Jul. 31, 2012

(87) PCT Pub. No.: WO2011/088510

PCT Pub. Date: Jul. 28, 2011

(65) Prior Publication Data

US 2012/0291318 A1 Nov. 22, 2012

(30) Foreign Application Priority Data

Jan. 22, 2010 (AU) ..... 2010900252

(51) Int. Cl.
*E02F 3/58* (2006.01)
*B66C 3/12* (2006.01)
*E02F 3/54* (2006.01)

(52) U.S. Cl.
CPC . *E02F 3/58* (2013.01); *B66C 3/125* (2013.01); *E02F 3/54* (2013.01)

(58) Field of Classification Search
CPC ..... E02F 3/48; E02F 3/52; E02F 3/54; B66C 3/125
USPC ..... 37/394, 396, 397, 398, 399; 294/68.27
See application file for complete search history.

(56) References Cited

U.S. PATENT DOCUMENTS

| | | | | | |
|---|---|---|---|---|---|
| 1,882,147 | A | * | 10/1932 | Humphreys et al. | 37/399 |
| 4,791,738 | A | * | 12/1988 | Briscoe | 37/399 |
| 4,944,102 | A | | 7/1990 | Behlendorf et al. | |
| 5,307,571 | A | * | 5/1994 | Behlendorf et al. | 37/396 |
| 5,367,798 | A | | 11/1994 | Hughes | |
| 5,636,460 | A | * | 6/1997 | Dretzka | 37/397 |

(Continued)

FOREIGN PATENT DOCUMENTS

| | | |
|---|---|---|
| AU | 2009202213 | 12/2009 |
| WO | WO-2009/140727 | 11/2009 |

OTHER PUBLICATIONS

International Search Report dated Apr. 27, 2011, directed to International Application No. PCT/AU2011/000057; 3 pages.

(Continued)

*Primary Examiner* — Jamie L McGowan
(74) *Attorney, Agent, or Firm* — Morrison & Foerster LLP

(57) ABSTRACT

A spreader component for use with a dragline excavator. Two dumpblocks are connected to the component in a spaced apart manner. The spreader component may include an in-use upper coupling arrangement for enabling coupling of the component to a hoist link of the dragline, at least first and second spaced apart in-use anterior coupling arrangements each for enabling coupling of the component to a respective dump block, and at least first and second spaced apart in-use lateral coupling arrangements each for enabling coupling of the component to a respective lift chain for a bucket of the excavator. An elongate connector may connect each lift chain to a respective lateral coupling arrangement in use.

16 Claims, 8 Drawing Sheets

(56) References Cited

U.S. PATENT DOCUMENTS

| | | | | |
|---|---|---|---|---|
| 5,657,559 | A * | 8/1997 | Immel | 37/394 |
| 5,752,334 | A * | 5/1998 | Immel | 37/396 |
| 5,970,636 | A * | 10/1999 | Briscoe et al. | 37/396 |
| 5,992,061 | A * | 11/1999 | Fleck et al. | 37/397 |
| 6,209,234 | B1 | 4/2001 | Meyers | |
| 7,472,502 | B2 * | 1/2009 | Gregory et al. | 37/397 |
| 7,774,959 | B2 * | 8/2010 | Kubo et al. | 37/195 |
| 8,572,870 | B2 * | 11/2013 | Kudo et al. | 37/444 |
| 2009/0183397 | A1 * | 7/2009 | Kubo et al. | 37/399 |
| 2013/0152431 | A1 * | 6/2013 | Buhse | 37/399 |

OTHER PUBLICATIONS

International Preliminary Report on Patentability dated Dec. 14, 2011, directed to International Application No. PCT/AU2011/000057; 3 pages.

Office Action dated Apr. 1, 2014, directed to CN Application No. 201180006727.5; 20 pages.

* cited by examiner 12
22
22'
18
32
32'
60
40'
$A_3'$ 12
22
22'
60
40'
18
40
$A_S$

22
$A_1$
$A_3$
$P_2$
$P_1$
$A_2$
4°

12
40
$A_1$
$A_2$
$A_3$
32
22
18
60
$A_S$
22'
60
$A_3'$
$A_2'$
32'
40'

12
22
40
18
34
$A_S$
22'
60
40'

SPREADER COMPONENT FOR A DRAGLINE EXCAVATOR

CROSS-REFERENCE TO RELATED APPLICATIONS

This application is a national stage application under 35 USC 371 of International Application No. PCT/AU2011/000057, filed Jan. 19, 2011, which claims the priority of Australian Patent Application No. 2010900252, filed Jan. 22, 2010, the contents of which prior applications are incorporated herein by reference.

FIELD OF THE INVENTION

A spreader component for use with a dragline excavator is disclosed. Such a component finds particular, though not exclusive, use as part of an upper rigging system for supporting a bucket of a mining-class dragline excavator, and will be described in this context. However, it is to be appreciated that the component is not specifically limited to this application. For example, the spreader component may find application with dragline excavators used in civil engineering applications, or potentially even with other drag-type excavators that employ hoists and lift chains, or the like.

BACKGROUND OF THE INVENTION

Large capacity mining draglines employ multiple dump blocks (or pulleys) to support and control the dragline bucket. For example, known mining draglines employ two dump blocks. The dump blocks are supported by a so-called "upper rigging" system. The configuration of the upper rigging system and the method in which the dump blocks are supported varies, even within mining-class dragline excavators.

Minimizing the mass of the upper rigging system permits a greater mass of overburden to be carried in the dragline bucket for a particular dragline structure. Furthermore, reducing the vertical dimension of the upper rigging system permits lifting of the bucket to a higher discharge position.

Because of the enormous forces and loads that a dragline bucket is subjected to and carries, the upper rigging system attempts to equalize the tension in each hoist rope, whilst still providing necessary degrees of freedom, so as to minimize component wear as the dragline operates in its intended manner.

The above references to the background art do not constitute an admission that such art forms a part of the common and/or general knowledge of a person of ordinary skill in the art. The above references are also not intended to limit the application of the spreader component disclosed herein.

SUMMARY OF THE INVENTION

In a first aspect there is disclosed a spreader component for use with a dragline excavator, in which two or more dump-blocks are connected to the component in a spaced apart manner. In one arrangement, each dump block supports a respective dump line that extends from a connection to the main drag line, around the dump block pulley, and to a connection to the bucket.

The spreader component comprises an in-use upper coupling arrangement for enabling coupling of the component to a hoist link of the dragline.

The spreader component further comprises at least first and second spaced apart in-use anterior coupling arrangements, each for enabling coupling of the component to a respective dump block.

The spreader component also comprises at least first and second spaced apart in-use lateral coupling arrangements, each for enabling coupling of the component to a respective lift chain for a bucket of the excavator. An elongate connector (e.g. a pin) is employed to connect each lift chain to a respective lateral coupling arrangement in use.

The spreader component as set forth herein is configured to accommodate the enormous forces and loads that a dragline bucket is subjected to and carries, and to assist the upper rigging system in attempting to equalize the tension in each hoist rope, whilst still providing necessary degrees of freedom, so as to minimize component wear.

In this regard, when the component is in use in a dragline and when viewed in side elevation, and a first (imaginary) plane is taken to extend generally centrally through the upper coupling arrangement and the anterior coupling arrangements, and a second (imaginary) plane is taken to extend generally centrally through the upper coupling arrangement and the lateral coupling arrangements, an angle is determined between the first and second planes.

This angle is selected or determined (i.e. the spreader component is so configured) such that, when a lifting force is applied to the hoist link, the resultant lift chain force on each elongate connector is generally orthogonal to the connector.

The terminology "generally orthogonal" is to be understood herein to include orthogonal as well as approaching orthogonality (e.g. including deviations of a few degrees).

In one embodiment the angle between the first and second lines is selected or determined to be acute and, more specifically, to be about 45° or greater. This angle has been found to be suitable across a range of dragline excavators in which the spreader component may be employed.

In one embodiment the lift chain connector can generally extend between an anterior and posterior of the component.

The predetermined (or "designed") configuration of the spreader component can be such as to minimize wear through the lift chain connector (e.g. pin) that connects the lift chain to the spreader component. In this regard, the configuration can result in the direction of force applied by the lift chain to the pin being perpendicular (or approaching perpendicularity) to the rotational axis of the pin. The spreader component can be designed to achieve this whilst, at the same time, avoiding a substantial increase in mass and vertical dimension of the upper rigging system.

The spreader component may, for example, be of unitary construction. The component can be formed to be strong and yet of a comparatively light weight and of smaller overall dimension. The resultant reduced mass of upper rigging can permit a greater mass of overburden to be carried in a dragline bucket for a given dragline structure. Furthermore, a reduced mass can permit the vertical dimension of the component and thus of the upper rigging system to be reduced, which enables lifting of the bucket to a higher discharge position.

The upper coupling arrangement can be such as to define a generally transverse axis along which can lie an elongate hoist link connector (e.g. a hoist link pin) for connecting the hoist link to the body.

Each of the anterior coupling arrangements can be such as to define a generally transverse axis along which can lie an elongate dump block connector (e.g. a dump block pin) for connecting the dump block to the body.

In one embodiment the spreader component is further configured such that, when the lifting force is applied to the hoist link, the resultant force on each of the lift chain connector, the hoist link connectors and the dump block connectors is generally orthogonal to the respective connector elongate axes. Thus, the spreader component can be configured to minimize wear through each of the elongate connectors (e.g. pins) that connect the hoist link, the dump blocks and the lift chains to the spreader component.

Each of the elongate connectors can be defined by a solid, highly shear-resistant pin.

In one embodiment the spreader component can be cast from a high tension steel. This can increase the strength and integrity of the component, allowing it to be formed so as to be comparatively light weight and smaller in overall dimension than existing spreader bar arrangements.

In one embodiment the body has a central axis of symmetry that extends between the anterior and posterior of the body. In this regard, when the spreader component is viewed in front elevation, the axis of symmetry can be seen to "cut" the body in half.

In this embodiment, (i) the upper coupling arrangement can comprise opposing upper mountings that are spaced from and located on respective sides of the central axis of symmetry. Each upper mounting may be arranged to project generally upwards from a remainder of the body in use of the component. This makes for considerable ease of coupling of the body to the hoist link.

In this embodiment, (ii) the anterior coupling arrangements can comprise anterior mountings located to project forwards from an anterior (front) face of the body in use of the component. The anterior mountings can be spaced from and located on respective sides of the central axis of symmetry. Each of the anterior mountings may comprise a mounting couple. Each mounting couple may again be easily coupled to a respective dump block.

In this embodiment, (iii) the lateral coupling arrangements can comprise lateral mountings located at each end of the body. The lateral mountings at each end can be spaced from and located on respective sides of the central axis of symmetry. Each of the lateral mountings may comprise a mounting couple arranged to project laterally out from a remainder of the body in use of the component. Again, this makes for considerable ease of coupling of the body to the lift chain.

In this embodiment, for integrity, each mounting can comprise a bush arranged to receive and retain therein a portion of its respective elongate connector. Further, for security, one of the bushes in each of the mountings can comprise a locking pin for selectively locking therein its respective connector once inserted into the mountings.

In the case of (i) the upper mountings can be spaced to receive therebetween a bush of the hoist link. The hoist link bush can be retained at the upper mountings when a hoist link pin is inserted through the upper mountings and hoist link bush. Again, the use of a bush for the hoist link increases the overall integrity of the upper rigging.

In the case of (ii) the anterior mountings can be spaced to receive therebetween a lobe of a respective coupling extending from the dump block. The lobe can be retained at the anterior mountings when a dump block pin is inserted through the anterior mountings and lobe, thereby coupling the dump block to its respective anterior mountings. Again, the use of a lobe in the dump block connector increases the overall integrity of the upper rigging.

In the case of (iii) the lateral mountings can be spaced to receive therebetween an end link of a respective lift chain. The end link may be modified to also comprise a lobe that is retained at the lateral mountings when a lift chain pin is inserted through the lateral mountings and end link lobe, to thereby connect the lift chain to its respective lateral mountings. Again, the use of a lobe in the end link increases the overall integrity of the upper rigging. If the lift chain is replaced by e.g. a wire rope, an end of the rope can be modified accordingly for securement to the lateral mountings. Thus, the term "lift chain" as employed herein is to be interpreted to include a wire rope.

In an embodiment, each of the anterior mountings can project forwards and at an angle slightly away from the central axis of symmetry. This angling away helps to better align the anterior mountings with the dump blocks, which each need to align with a respective dump line-to-drag line connection.

In a second aspect there is disclosed an upper rigging system for use with a dragline (or drag-type) excavator. The system includes a spreader component according to the first aspect, as set forth above.

In a third aspect there is disclosed a dragline (or drag-type) excavator that includes a spreader component according to the first aspect, as set forth above.

BRIEF DESCRIPTION OF THE DRAWINGS

In the drawings, prior art upper rigging systems are shown in FIGS. 1 to 3 by way of background. Again, references to these prior art upper rigging systems does not constitute an admission that such systems form a part of the common and/or general knowledge of a person of ordinary skill in the art. In these prior art drawings.

Figure 4:
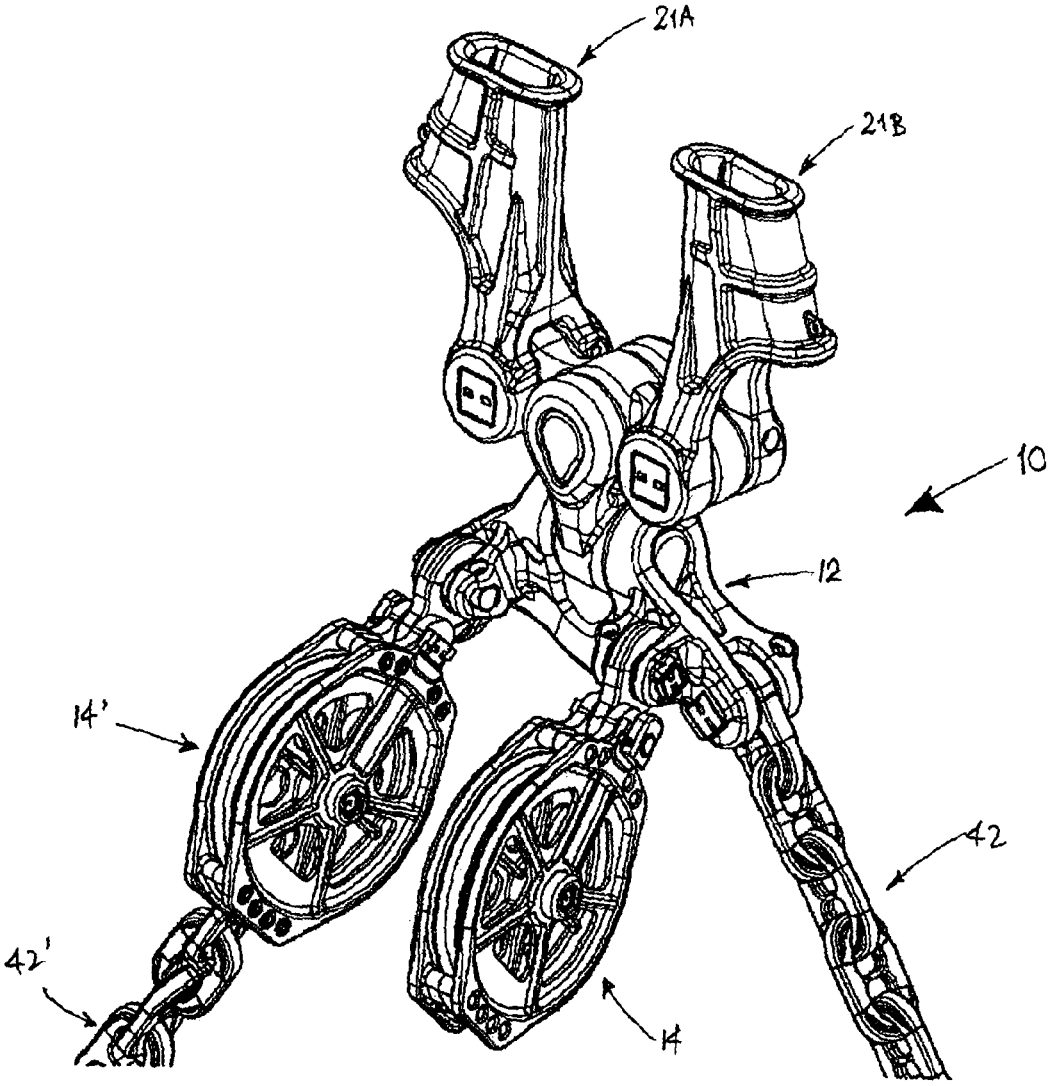
Figure 5:
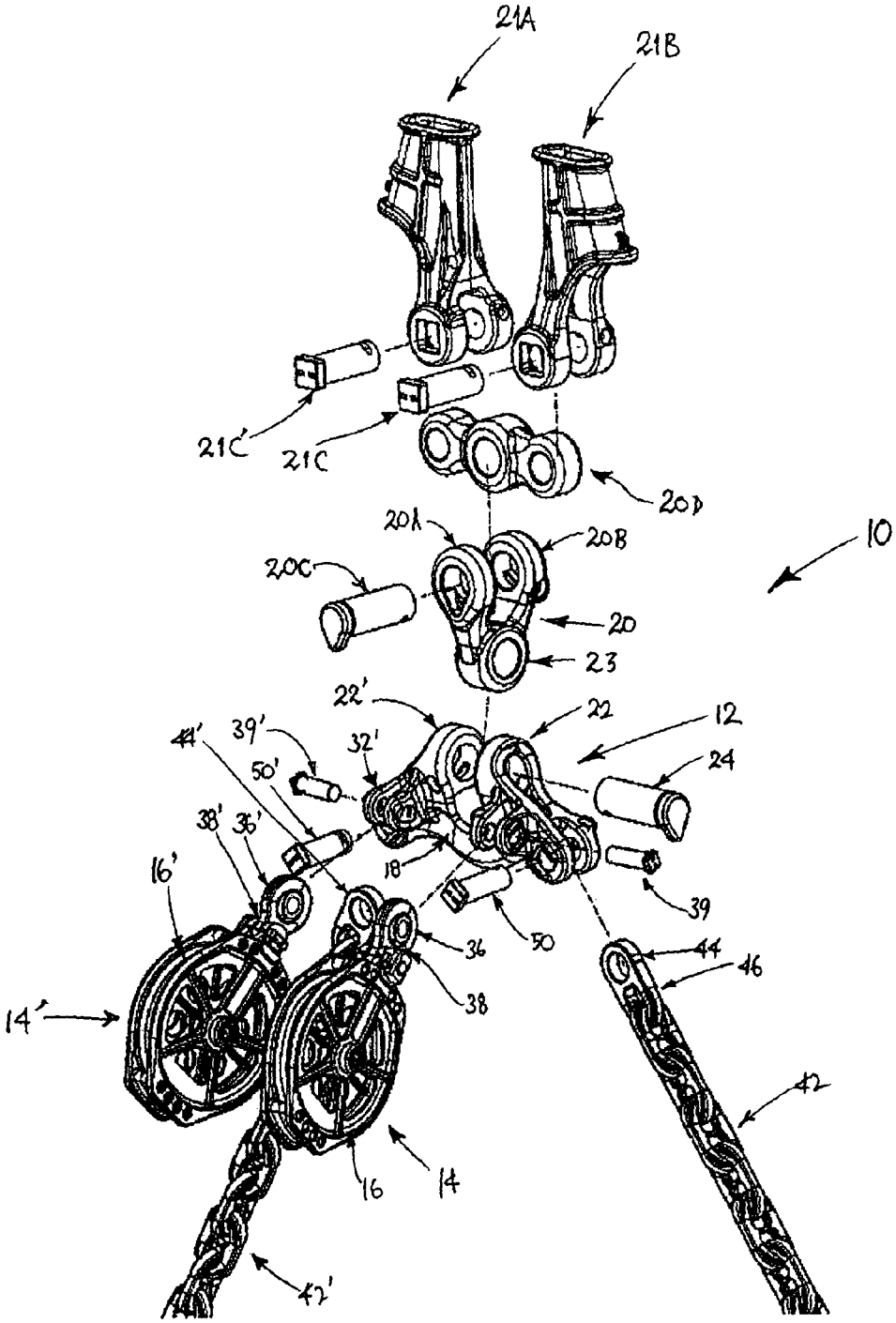
Figure 11:
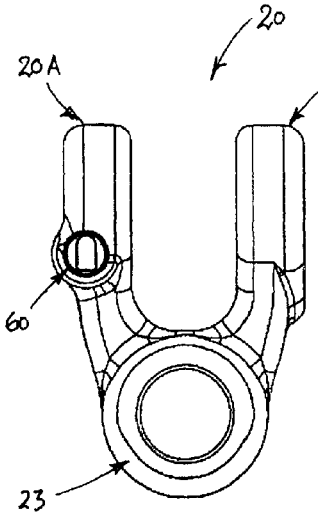
Figure 12:
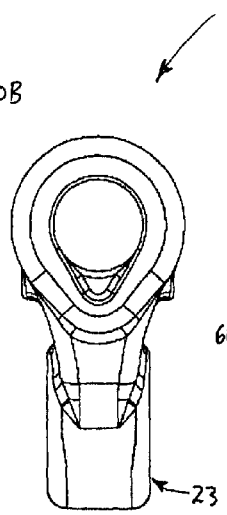
Figure 13:
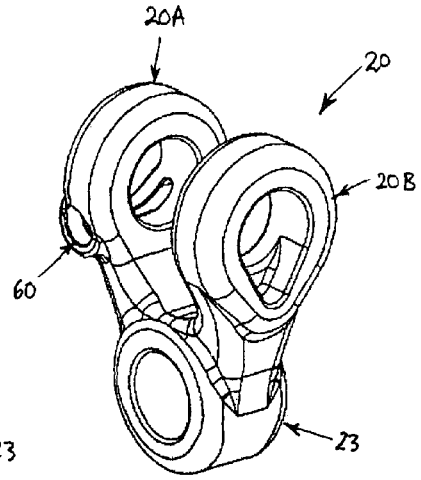
Figure 14:
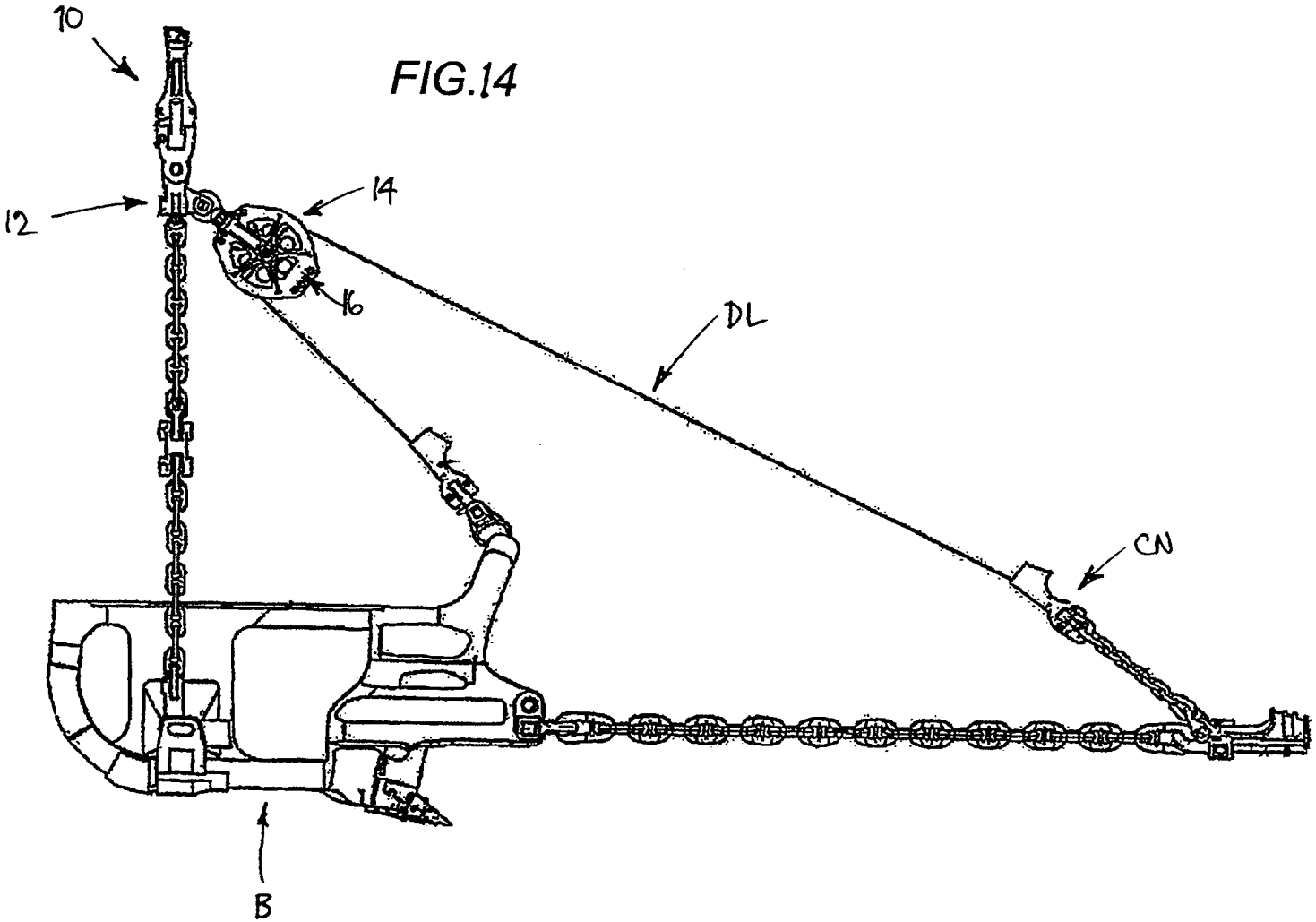

Notwithstanding any other forms which may fall within the scope of the spreader component and upper rigging system as set forth in the Summary, after firstly briefly describing the prior art, a specific embodiment will then be described, and by way of example only, with reference to the accompanying drawings in which:

FIG. 4 shows a perspective assembly view of an embodiment of an upper rigging system incorporating an embodiment of a spreader component as set forth in the Summary;

FIG. 5 shows a perspective exploded view of the upper rigging system embodiment of FIG. 4;

FIGS. 6 to 10 respectively show plan, perspective, front, side and rear views of the embodiment of the spreader component shown in FIGS. 4 and 5;

FIGS. 11 to 13 respectively show front, side and perspective views of an upper hoist link embodiment employed in the upper rigging system of FIGS. 4 and 5; and FIG. 14 shows a side elevation the upper rigging system embodiment of FIG. 4 in use with a dragline bucket.

DETAILED DESCRIPTION OF THE INVENTION

Figure 1:
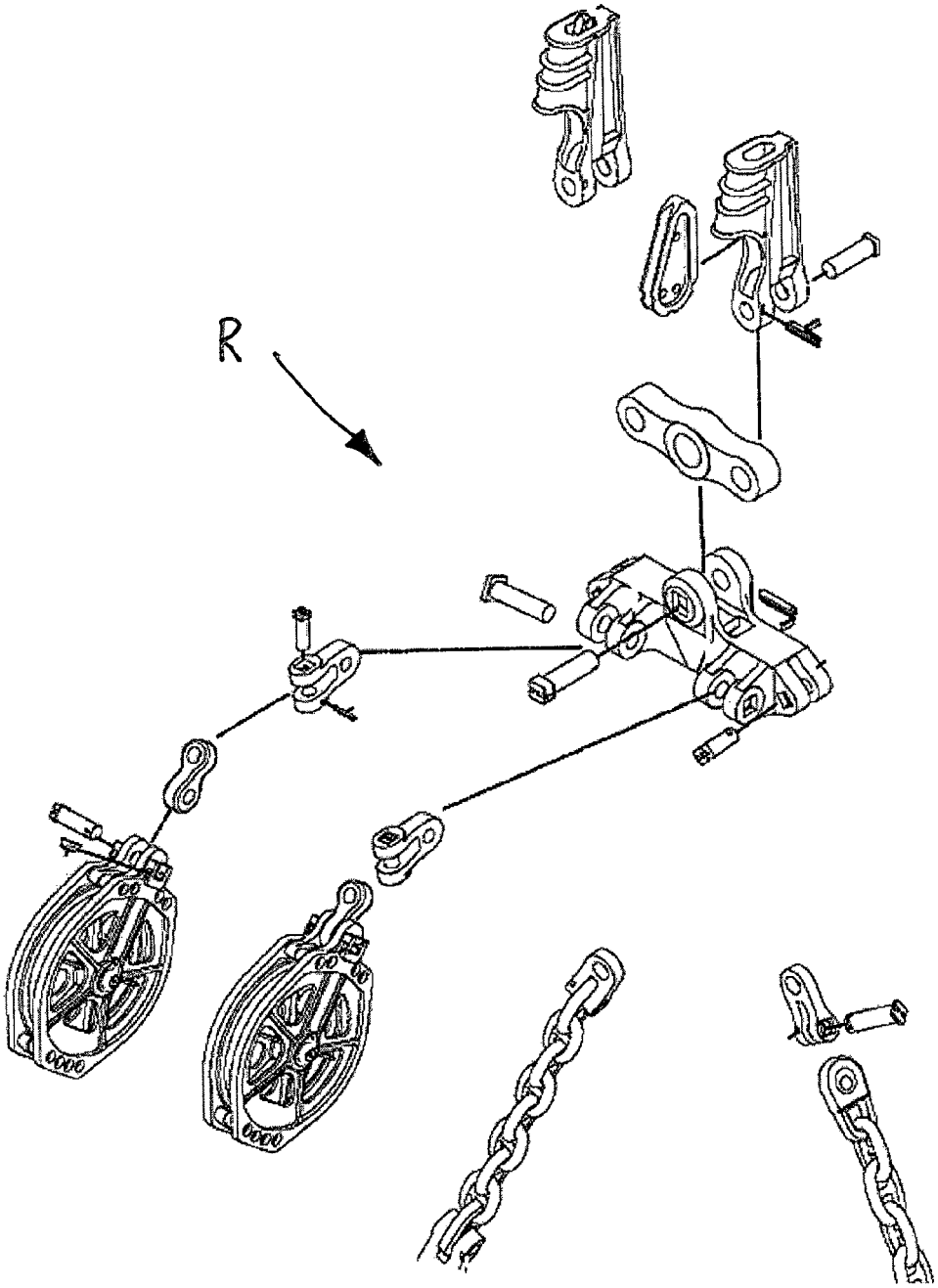
FIGURE 1 (Prior Art)
FIG. 1 shows an exploded view of a known upper dragline rigging.
Figure 2:
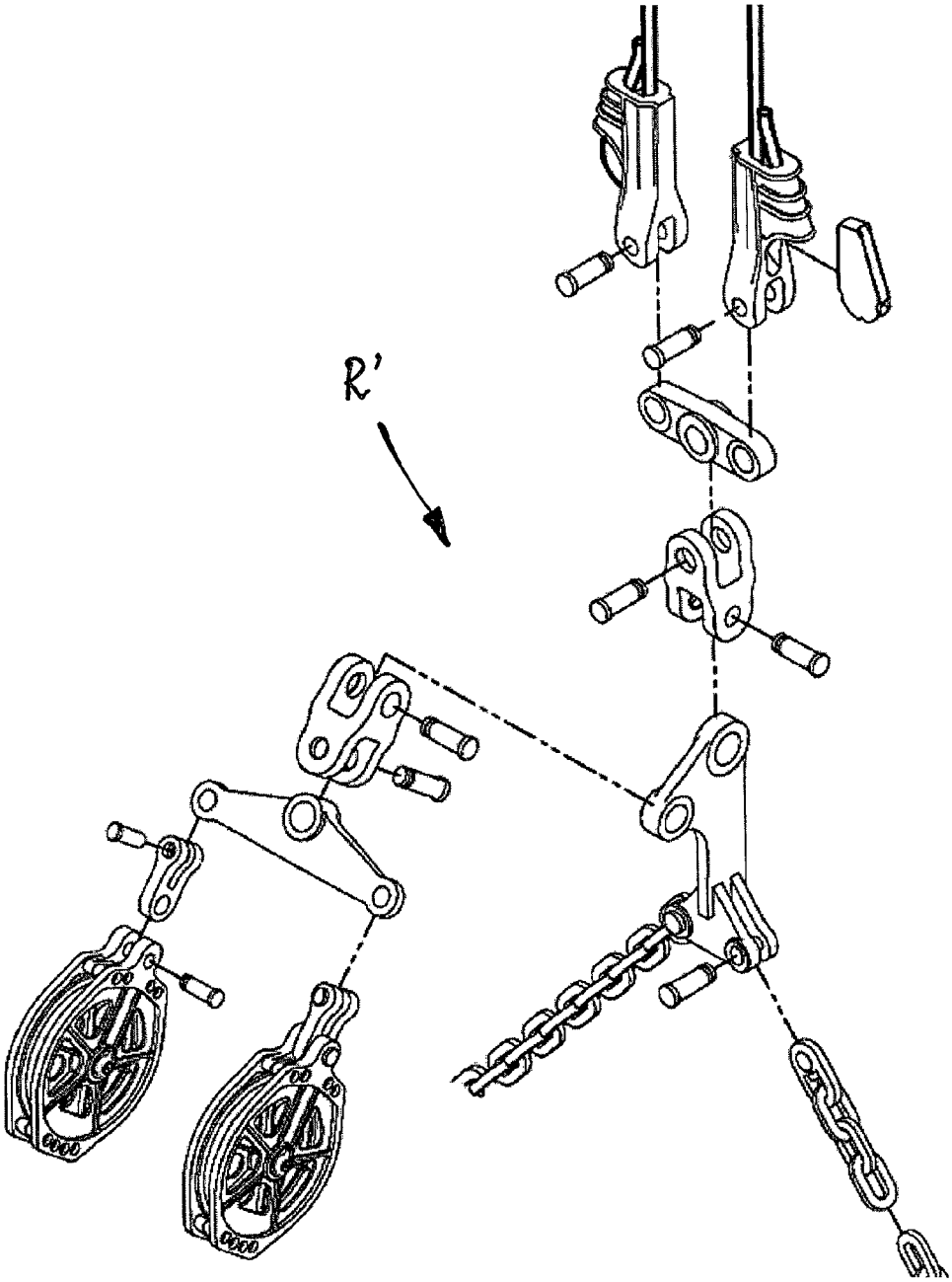
FIGURE 2 (Prior Art)
FIG. 2 shows an exploded view of a known alternative upper dragline rigging.
Figure 3:
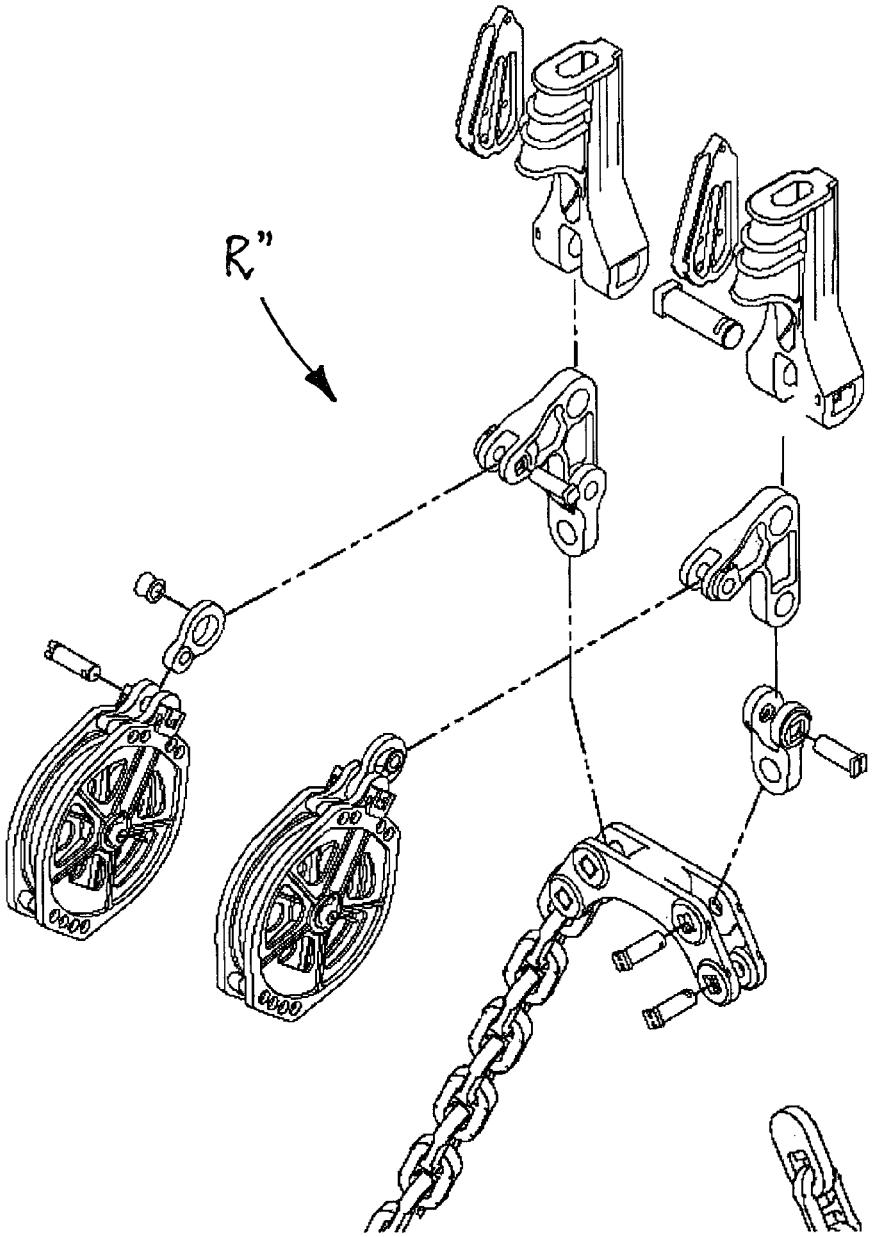
FIGURE 3 (Prior Art)
FIG. 3 shows an exploded view of another known alternative upper dragline rigging.

Prior to describing the spreader component and upper rigging as disclosed herein and as illustrated in FIGS. 4 to 13, three known (prior art) upper rigging systems as shown in FIGS. 1 to 3 will be briefly described.

FIG. 1 shows an exploded view of a first known upper dragline rigging R. This rigging was developed to equally distribute hoist rope tension, however, it could not provide a forward axis of rotation. This resulted in thrusting occurring in the primary upper pin, and caused misalignment between the upper hoist chain and spreader bar, resulting in accelerated wear.

FIG. 2 shows an exploded view of a second known upper dragline rigging R'. This rigging was developed to provide additional degrees of freedom, however, this resulted in additional components. This added an undesired and excessive mass, as well as an excessive height to the upper rigging system.

FIG. 3 shows an exploded view of a third known upper dragline rigging R". This rigging was again developed to provide additional degrees of freedom, however, did not properly equalise hoist rope tensions.

Referring now to FIGS. 4 to 13, an upper rigging system 10 is shown that incorporates a spreader component in the form of an upper spreader bar 12 that is of unitary construction. For example, the upper spreader bar 12 can be cast from high tension steel. This increases the strength and integrity of the upper spreader bar 12, allowing it to be formed to be comparatively light weight and of smaller overall dimension. This in turn minimizes the mass of the upper rigging system in which the spreader bar 12 is employed, permitting a greater mass of overburden to be carried in the dragline bucket of a given dragline structure. Furthermore, this reduces the vertical dimension of the upper rigging system, which enables lifting of the bucket to a higher discharge position. This reduced overall dimension can be best appreciated in FIG. 4.

The spreader bar configuration also allows equalisation of the hoist rope tensions. The upper rigging system 10 and upper spreader bar 12 find particular, though not exclusive, use with mining-class dragline excavators.

In FIGS. 4 and 5 it will be seen that two dump blocks 14 and 14' are connected to the upper spreader bar 12 in a spaced apart manner. Each dump block comprises a pulley 16, 16' that supports a respective dump line. As shown in FIG. 14, the dump line DL is used to maneuver (tilt) the bucket B and extends from a connection CN for the dump line and drag line, then around the pulley 16, to then connect in relation to the bucket B.

The upper spreader bar 12 comprises a main bar part 18. It will be seen in FIGS. 6, 8 and 10 that the main bar part 18 has a central axis of symmetry $A_S$ that extends between the anterior (front) and posterior (rear) of the spreader bar 12. This axis of symmetry $A_S$ can be seen to "cut" the spreader bar 12 in half, which contributes to a balancing within the spreader bar.

The bar part 18 comprises an integral upper coupling arrangement for enabling coupling of the bar part 18 to a hoist link 20 of the dragline (FIGS. 11 to 13 show the hoist link 20 in further detail). The upper coupling arrangement takes the form of opposing upper mounting bushes 22, 22' that are spaced from and located on respective sides of the central axis of symmetry $A_S$.

As best shown in FIG. 5, the hoist link 20 is connected via its in-use upwardly projecting bushes 20A and 20B, and via a pin 20C, to an intermediate connector 20D. Intermediate connector 20D is referred to as a "hoist equaliser" and contributes towards equalisation of hoist rope tensions. The intermediate connector 20D connects the hoist link 20 to the hoist line connectors 21A and 21B of the upper rigging system, via pins 21C, 21C'.

In the main bar part 18, each mounting bush 22, 22' projects generally upwards in use from a remainder of the bar part 18. This makes for ease of coupling of the bar part 18 to the hoist link 20. In this regard, the bushes 22 are spaced to snugly receive therebetween a bush portion 23 of the hoist link 20. The opposing upper mounting bushes 22 define a generally transverse hoist link axis $A_1$ therethrough and along which can be inserted an elongate hoist link connector in the form of a shear-resistant pin 24 (i.e. through the aligned holes of the bushes and hoist link). The pin 24 thus connects the hoist link 20 to the upper spreader bar 12, whilst allowing for forwards/backwards rotation of the spreader bar relative to the hoist link.

The bar part 18 further comprises integral first and second spaced apart in-use anterior coupling arrangements, each for enabling coupling of the bar part 18 to a respective dump block 30. Each anterior coupling arrangement takes the form of anterior (front) mounting bush pairs 32, 32' located to project forwardly in use from an anterior (front) face 34 of the bar part 18. The mounting bush pairs 32, 32' are spaced from and located on respective sides of the central axis of symmetry $A_S$. Each of the mounting bush pairs projects forwardly and at a slight angle away from the axis of symmetry $A_S$ (see FIG. 6). This angling away helps each pair to better align with its respective dump block, which needs to align with a respective dump line-to-drag line connection and bucket connection.

Again, the mounting bush pairs 32, 32' make for easy coupling to a respective dump block 14 and 14'. In this case, the bushes in each pair are spaced to snugly receive therebetween a lobe 36, 36' of a respective coupling 38, 38' extending from the dump blocks. Each coupling 38, 38' is cast from high tension steel so as to increase the overall integrity of the upper rigging.

The lobe 36, 36' is retained at the mounting bush pairs 32, 32' when an elongate dump block connector in the form of a shear-resistant pin 39, 39' is inserted through the aligned holes of the bushes and lobe, thereby coupling each dump block to the upper spreader bar 12. The coupling occurs via a spool and is such as to allow for a limited amount of upwards/downwards pivoting relative to the spreader bar, and for a limited amount rotation of each dump block about a vertical axis. The bushes in each bush pair 32, 32' define generally transverse dump block axes $A_2$ and $A_2'$ therethrough, and along which the pins 39, 39' extend.

The bar part 18 further comprises first and second spaced apart in-use lateral coupling arrangements in the form of lateral bush pairs 40, 40' located at respective ends of the main bar part 18. The lateral bush pairs 40, 40' are each spaced from and located on respective side of the axis of symmetry $A_S$. Each of the lateral bush pairs 40, 40' project laterally out and downwards in use from a remainder of the bar part 18 to make for ease of coupling of the upper spreader bar 12 to a respective lift chain 42, 42'. The lift chains 42, 42' in turn couple the upper spreader bar 12 in relation to a bucket of the excavator for lifting of the bucket in use.

The bushes in each of the lateral bush pairs 40, 40' are spaced to snugly receive therebetween a lobe 44, 44' of a modified end link 46, 46' of a respective lift chain 42, 42'. The end links are retained at their respective the lateral bush pairs when an elongate lift chain connector in the form of a lift chain pin 50, 50' is inserted through the aligned holes in bushes and lobe, to thereby connect the lift chain to the upper spreader bar 12. Again, the use of a lobe in the end link increases the overall integrity of the upper rigging.

The connection is such as to allow for upwards/downwards pivoting of the end link 46, 46' relative to the spreader bar 12. Further, the bushes in each lateral bush pair 40, 40' define forwards-rearwards extending lift chain axes $A_3$ and $A_3'$ therethrough, and along which the pins 50, 50' extend.

Figures 6, 7, 8, 9, 10:
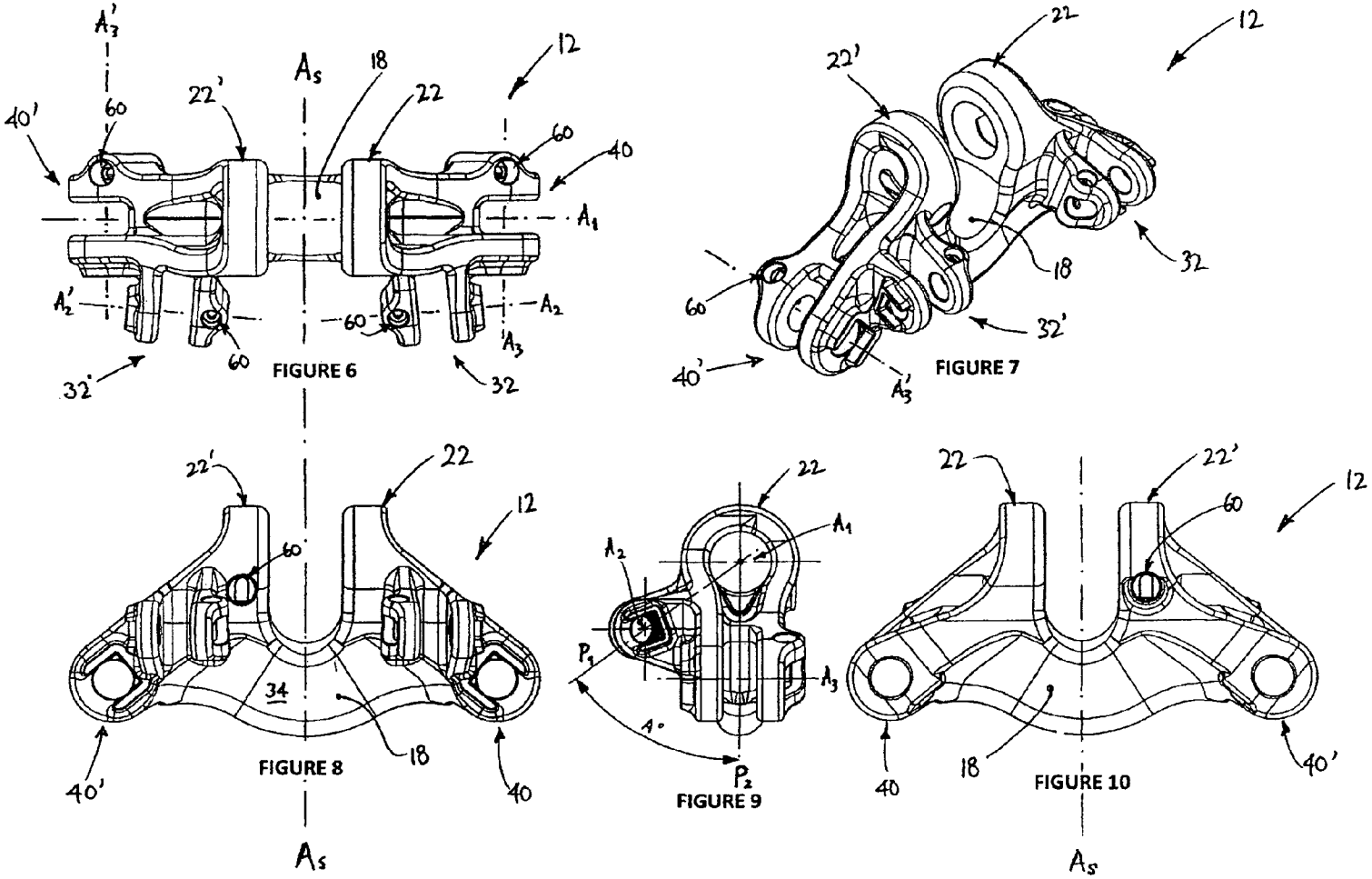

As disclosed herein the upper spreader bar 12 is provided with a predetermined configuration to optimize its use in an upper rigging of a dragline. In this regard, and as shown in FIG. 9, a first (imaginary) plane $P_1$ can be defined in which lies the hoist link axis $A_1$, with the plane extending generally centrally through the mounting bush pairs 32, 32' to intersect with each of the dump block axes $A_2$. Further, a second (imaginary) plane $P_2$ can be defined in which lies the hoist link axis $A_1$, and which "bisects" (and extends orthogonally with respect to) the lift chain axes $A_3$. As shown in FIG. 9, an angle of A° is defined between the planes $P_1$ and $P_2$. The angle is predetermined between the first and second planes, with the angle being selected such that, when a lifting force is applied to the hoist link, the resultant lift chain force on each elongate connector is generally orthogonal to the connector. In this regard, the angle is "designed into" the upper spreader bar 12.

Put another way, the angle A° can be defined as the angle which subtends a plane lying on both axes $A_1$ and $A_2$ of the dump block connection pin 50, 50' and primary upper pin 24, and a plane bisecting the upper pin 24 and the upper pin axis $A_1$.

Optimally, the angle A° is an acute angle. More optimally is predetermined or designed to be about 45° or greater. Such an angle has been found to be suitable across a range of dragline excavators in which the upper spreader bar 12 may be employed.

This angle A° can be predetermined, or optimized, to the given upper rigging of generally any given dragline. The angle is predetermined or optimized such that, when a lifting force is applied to the hoist link 20, the resultant force on at least each of the pins 50, 50' is generally orthogonal to the respective axes $A_3$ and $A_3'$. Put another way, the configuration results in the direction of force applied by each lift chain to its respective pin being perpendicular (or approaching perpendicularity) to the rotational (longitudinal) axis of the pin. The upper spreader bar 12 has been designed to achieve this outcome whilst avoiding a substantial increase in mass of the upper rigging system.

The terminology "generally orthogonal" is to be understood herein to include orthogonal (i.e. 90°), as well as a resultant direction of force that approaches (or deviates slightly) by a few degrees from orthogonal.

This predetermined or optimized configuration of the upper spreader bar 12 has been observed to minimize wear at each of the pins 50, 50' (i.e. at the lift chain to spreader bar connection).

The design of the spreader bar embodiment shown in FIGS. 4 to 10 has been further enhanced such that, when the lifting force is applied to the hoist link 20, the resultant force on each of the lift chain, hoist link and dump block pins is generally orthogonal to their respective axes. Thus, the upper spreader bar 12 can minimize wear through each such pin. Each of the pins is solid and comprises a highly shear-resistant steel.

In the spreader bar of FIGS. 4 to 10, one of the bushes in each of the bush pairs is adapted to receive a locking pin 60 therein. The locking pin can selectively lock its respective pin, after it has been inserted into the bush pairs, to lock each of the hoist link, the dump blocks and the lift chains to the upper spreader bar 12.

The upper rigging system 10 and upper spreader bar 12 disclosed herein were observed to allow proper operation of the dragline bucket in its intended manner; and to equally distribute the suspended mass of the combined bucket, payload and rigging between each hoist rope. The upper rigging system 10 and upper spreader bar 12 were able to be configured such that the force applied through a pinned joint was substantially perpendicular to the rotational axis of the pin. The upper rigging system 10 and upper spreader bar 12 were also able to minimise the collective mass of the rigging arrangement, and could be configured to be small in the vertical dimension.

The angle A° (FIG. 9) was observed to be related to the dragline bucket and rigging geometry as a whole (i.e. increasing the hoist line length was observed to change the required/predetermined angle).

It was further noted that the relative geometry of known dragline arrangements varied little in this respect. The angle A° was thus set at a safe margin greater than 45°. It was also noted that the prior art riggings maintained an angle notably less than 45°. It was further noted that if a rigging and bucket arrangement was configured in such a way that an angle of 45° or less was possible, the geometry of the rigging went outside of a desired working envelope and offered unworkable inconveniences (e.g. lift chains long and heavy). In addition, varying the angle A to be notably less than 45° caused a misalignment in the lift chain pin.

Investigations revealed that, in order to maintain a minimum angle of misalignment between the direction of applied force of the upper hoist chain and the upper hoist chain connecting pin 24 to minimize wear as defined above, the value of A was desirably greater than 45°. An alternate definition was that the line of force applied by the dump block to the upper spreader bar should coincide with the axis of the primary upper pin during the bulk of operation of the dragline. For this to be achieved, the angle of A was made to be at or greater than 45 degrees when used with known rigging arrangements.

It was further noted that, in use, loading was not always perfectly perpendicular to pin axes, but was within a degree or two most of the time (importantly when the bucket was fully laden). In addition, it was noted that the spreader bar 12 could be used with known buckets and rigging.

As mentioned above, the lateral bush pairs 40, 40' may instead receive therebetween a modified end of a respective wire rope (i.e. instead of a lift chain 42, 42'). The lift chain pins 50, 50' may thus be inserted through the modified wire rope ends to connect the ropes to the upper spreader bar 12.

Whilst a specific embodiment of a spreader component and upper rigging has been described, it should be appreciated that the spreader component and upper rigging may be embodied in other forms.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the spreader component and upper rigging as disclosed herein.

The invention claimed is:

1. A spreader component for a dragline excavator, in which two or more dumpblocks are connected to the component in a spaced apart manner, the spreader component comprising:

an upper coupling arrangement for enabling coupling of the component to a hoist link of the dragline, the upper coupling arrangement defining a generally transverse axis along which can lie an elongate hoist link connector for connecting the hoist link to the spreader component;

at least first and second spaced apart anterior coupling arrangements, each for enabling coupling of the component to a respective dump block;

at least first and second spaced apart lateral coupling arrangements, each for enabling coupling of the component to a respective lift chain for a bucket of the excavator, wherein an elongate lift chain connector connects each lift chain to a respective lateral coupling arrangement;

the spreader component configured such that when assembled in a dragline and when viewed in side elevation:

a first plane extends generally centrally through the upper coupling arrangement and the anterior coupling arrangements;

a second plane extends generally centrally through the upper coupling arrangement and the lateral coupling arrangements; and an angle is determined between the first and second planes, with the angle being selected such that, when a lifting force is applied to the hoist link, the resultant lift chain force on each elongate lift chain connector is generally orthogonal to the elongate lift chain connector.

2. The component of claim 1, wherein the angle is an acute angle and is about 45° or greater.

3. The component of claim 1, wherein the elongate lift chain connector generally extends between an anterior and posterior of the component.

4. The component of claim 1, wherein the anterior coupling arrangements each define a generally transverse axis along which can lie an elongate dump block connector for connecting the dump block to the component.

5. The component of claim 4, that is further configured such that, when the lifting force is applied to the hoist link, the resultant force on each elongate lift chain connector, the elongate hoist link connectors and the elongate dump block connectors is generally orthogonal to the respective connector elongate axes.

6. The component of claim 1, that is of a unitary construction.

7. The component of claim 1, that has a central axis of symmetry that extends between an anterior and posterior of the body, wherein:

(i) the upper coupling arrangement is symmetrical about the axis of symmetry;

(ii) the anterior coupling arrangements are spaced from and located on respective sides of the axis of symmetry;

(iii) the lateral coupling arrangements are spaced from and located on respective sides of the central axis of symmetry.

8. The component of claim 7, wherein each anterior coupling arrangement projects forwards and at an angle slightly away from the central axis of symmetry.

9. The component of claim 1, wherein each coupling arrangement comprises spaced bushes arranged to receive therethrough and lock therein a respective connector.

10. An upper rigging system for use with a dragline excavator, the system including a spreader component as claimed in claim 1.

11. A dragline excavator comprising the spreader component of claim 1.

12. The component of claim 2, wherein the elongate lift chain connector generally extends between an anterior and posterior of the component.

13. An upper rigging system for supporting a bucket of a dragline excavator comprising:

a spreader component, a hoist link, two dump blocks, and lift chains, the spreader component comprising:

an upper coupling arrangement connected to the hoist link, the upper coupling arrangement defining a generally transverse axis along which an elongate hoist link connector extends that connects the hoist link to the spreader component;

first and second spaced apart anterior coupling arrangements coupling the spreader component to respective ones of the dump blocks which are connected to the bucket, wherein an elongate dump block connector connects each dump block to respective ones of the anterior coupling arrangements;

first and second spaced apart lateral coupling arrangements coupling the spreader component to respective ones of the lift chains which are connected to the bucket, wherein an elongate lift chain connector connects each lift chain to respective ones of the lateral coupling arrangements;

the spreader component being configured such that, when assembled in a dragline and when viewed in side elevation:

a first plane is taken to extend generally centrally through the upper coupling arrangement and the anterior coupling arrangements;

a second plane is taken to extend generally centrally through the upper coupling arrangement and the lateral coupling arrangements; and an angle is determined between the first and second planes, wherein in use the angle is selected such that, when a lifting force is applied to the hoist link to the lift the bucket, the resultant lift chain force of each elongate lift chain connector is generally orthogonal to the elongate lift chain connector.

14. The upper rigging system of claim 13, wherein, when a lifting force is applied to the hoist link to lift the bucket, the resultant force on the elongate dump block connectors is generally orthogonal to respective ones of the elongate dump block connectors.

15. The upper rigging system of claim 13, wherein, when a lifting force is applied to the hoist link to lift the bucket, the resultant force on the elongate hoist link connector is generally orthogonal to the elongate hoist link connector.

16. The upper rigging system of claim 13 further comprising the bucket.

* * * * *